US008310900B2

(12) United States Patent
Abe

(10) Patent No.: US 8,310,900 B2
(45) Date of Patent: Nov. 13, 2012

(54) TIME INFORMATION OBTAINING DEVICE AND RADIO CLOCK

(75) Inventor: Hideo Abe, Tokorozawa (JP)

(73) Assignee: Casio Computer Co., Ltd., Tokyo (JP)

( * ) Notice: Subject to any disclaimer, the term of this patent is extended or adjusted under 35 U.S.C. 154(b) by 797 days.

(21) Appl. No.: 12/499,240

(22) Filed: Jul. 8, 2009

(65) Prior Publication Data

US 2010/0014388 A1 Jan. 21, 2010

(30) Foreign Application Priority Data

Jul. 17, 2008 (JP) ..... 2008-185515

(51) Int. Cl.
*G04C 11/02* (2006.01)

(52) U.S. Cl. ..... 368/47

(58) Field of Classification Search ..... 368/47
See application file for complete search history.

(56) References Cited

U.S. PATENT DOCUMENTS

| | | | | |
|---|---|---|---|---|
| 6,346,911 | B1 | 2/2002 | King | |
| 7,428,190 | B2 * | 9/2008 | Sano | 368/47 |
| 7,738,322 | B2 * | 6/2010 | Murata et al. | 368/47 |
| 2004/0093532 | A1 * | 5/2004 | Hotta et al. | 713/500 |
| 2005/0147080 | A1 | 7/2005 | Haefner et al. | |
| 2005/0195690 | A1 | 9/2005 | Kondo | |
| 2006/0050824 | A1 | 3/2006 | Kondo | |
| 2006/0109835 | A1 * | 5/2006 | Saitoh | 370/350 |
| 2007/0140064 | A1 * | 6/2007 | Fujisawa | 368/47 |
| 2008/0239880 | A1 * | 10/2008 | Murata et al. | 368/47 |
| 2009/0016171 | A1 * | 1/2009 | Fujisawa | 368/47 |

FOREIGN PATENT DOCUMENTS

| | | | |
|---|---|---|---|
| CN | 1422384 | A | 6/2003 |
| JP | 2005-249632 | A | 9/2005 |
| WO | WO 01/75470 | A1 | 10/2001 |

OTHER PUBLICATIONS

Extended European Search Report dated Oct. 4, 2010 (in English) issued in counterpart European Application No. 09164359.3.
Chinese Office Action dated Mar. 16, 2011 (and English translation thereof) in counterpart Chinese Application No. 200910151777.7.

* cited by examiner

*Primary Examiner* — Sean Kayes
(74) *Attorney, Agent, or Firm* — Holtz, Holtz, Goodman & Chick, PC

(57) ABSTRACT

Disclosed is a time information obtaining device comprising: a reception section to receive a standard time radio wave; an input waveform data generation section to generate input waveform data, based on data having the unit of time length; an estimated waveform data generation section to generate estimated waveform data, wherein the estimated waveform data comprises the value in which each sample point is described by the plurality of bits, and has the same time length as the input waveform data, and comprises at least one code which configures the time code, and a waveform of the estimated waveform data is sequentially shifted by a predetermined sample; a correlation value calculation section to calculate a correlation value; a correlation value comparison section to compare the correlation value to calculate an optimal value; and a control section to specify a beginning position of a second in the time code.

9 Claims, 14 Drawing Sheets

TIME INFORMATION OBTAINING DEVICE AND RADIO CLOCK

CROSS-REFERENCE TO RELATED APPLICATIONS

This application is based upon and claims the benefit of priority from the prior Japanese Patent Application No. 2008-185515 filed on Jul. 17, 2008, the entire contents of which are incorporated herein by reference.

BACKGROUND OF THE INVENTION

1. Field of the Invention

The present invention relates a time information obtaining device to receive a standard time radio wave so as to obtain time information thereof, and a radio clock mounted with the time information obtaining device.

2. Description of the Related Art

Presently, in countries such as Japan, Germany, the United Kingdom, Switzerland, and the like, a standard time radio wave having a long wave is transmitted from transmitting stations. For example, in Japan, standard time radio waves of 40 kHz and 60 kHz, which are performed with an amplitude modulation, are transmitted from a transmitting station located in Fukushima prefecture and in Saga prefecture, respectively. The standard time radio wave contains a sequence of codes which configure a time code indicating year/month/day/hour/minute, so that the time code is transmitted in 60 seconds per one period. That is to say, a period of the time code is 60 seconds.

There has been in practical use ad clock (a radio clock) in which the standard time radio wave including such time code is received, the time code is extracted from the received standard time radio wave, and the time can be corrected A reception circuit of the radio clock comprises a band-pass filter (BPF) to receive the standard time radio wave received by an antenna and to extract only a standard time radio wave signal; a demodulation circuit to demodulate the standard time radio wave signal which has been performed with an amplitude modulation by an envelope detection, and the like; and a processing circuit to read the Lime code included in the signal which is demodulated by the demodulation circuit.

In the conventional processing circuit, a synchronization is performed at the rising of the demodulated signal, a binarization is performed at a predetermined sampling period, and a TCO data having a unit of time length (1 second) which is a binary bit sequence is obtained. Further, the processing circuit measures the pulse width (that is to say, the time during a bit "1", and a bit "0") of the TCO data, determines either one of the codes of "P", "0", and "1" according to the size of the width, and obtains the time information based on the sequence of the determined code.

The conventional processing circuit undergoes the process of: second synchronization processing; minute synchronization processing; a code incorporation; and a matching judgment, from the starting of the reception of the standard time radio wave to the obtaining of the time information. When the processing cannot be terminated suitably in each process, the processing circuit is required to undergo the processing again from the beginning. Thus, there may be a case in which the processing has to be performed over and over again due to the influence of the noises included in the signal, which results in the time until the time information can be obtained being extremely long.

The second synchronization is to detect the rising of the code which happens every 1 second, among the codes indicated by the TCO data. By repeating the second synchronization, one can detect the portion where a position marker "P0" positioned at an ending of a frame, and a marker "M" positioned at a beginning of the frame are continued. The continued portion is to appear every 1 minute (60 seconds) The position of the marker "M" is where the data of the beginning frame exists among the TCO data. This detection is referred to as the minute synchronization.

Since the beginning of the frame is recognized by the above mentioned minute synchronization, the incorporation of the codes is thereafter started. After the data for 1 frame is obtained, a parity bit is checked, and whether it is an impossible value (a value in which the year/month/day/minute/second cannot be realized), or not is judged (the matching judgment). For example, since the minute synchronization is to detect the beginning of the frame, the minute synchronization may take 60 seconds. Of course, in order to detect the beginning of the plurality of frames, it may take several times longer.

In the disclosure of US2005/0195690A1, a demodulated signal is performed with a binarization at a predetermined sampling interval (50 ms) so as to obtain the TCO data. Further, a data group which comprises a binary bit sequence for every 1 second (20 samples) is listed. The device disclosed in US2005/0195690A1 performs a comparison of the bit sequence with a template of the binary bit sequence indicating the code "P: position marker", a template of the binary bit sequence indicating the code "1", and a template of the binary bit sequence indicating the code "0", respectively, so as to obtain the correlation thereof. Thus, it is judged which of the codes "P", "1", and "0" the bit sequence corresponds to based on the correlation.

In the technique disclosed in US2005/0195690A1, the TCO data which is the binary bit sequence is obtained so as to perform the matching with the template. Thus, in a state where the electric intensity is weak or many noises are contained in the demodulated signal, the obtained TCO data is likely to contain a lot of errors. Accordingly, one had to perform fine adjustments to a filter to remove the noises from the demodulated signal and a threshold of the AD converter, so as to improve the quality of the TCO data.

Further, when the data having a unit of time length (1 second) is judged to have any one of the codes "P", "1", and "0", another judgment processing has to be performed for the beginning of a second, and the beginning of a minute, based on the obtained judgment results. Here, when the beginning of the second and the beginning of the minute cannot be detected suitably, the processing is required to be undergone again.

The present invention is made for the purpose of providing: a time information obtaining device in which the beginning position of the codes of the standard time radio wave can be specified and the codes included in the standard time radio wave can be suitably obtained, without being influenced by the state of the electric intensity and the noises of the signals; and a radio clock comprising the time information obtaining device.

SUMMARY OF THE INVENTION

One of the objects of the present invention is achieved by a time information obtaining device comprising:

a reception section to receive a standard time radio wave;

an input waveform data generation section to generate input waveform data having one or more unit of time length, based on data having the unit of time length, wherein the data comprises a value which is obtained by sampling a signal including a time code output from the reception section in a predetermined sampling period and by each sample point being described by a plurality of bits, and wherein the unit of time length is a time corresponding to one code which configures the time code;

an estimated waveform data generation section to generate a plurality of pieces of estimated waveform data, wherein the estimated waveform data comprises the value in which each sample point is described by the plurality of bits, the estimated waveform data has the same time length as the input waveform data, the estimated waveform data comprises at least one code which configures the time code, and a waveform of the estimated waveform data is sequentially shifted by a predetermined sample;

a correlation value calculation section to calculate a correlation value of the input waveform data and each of the plurality of pieces of estimated waveform data;

a correlation value comparison section to compare the correlation value calculated by the correlation value calculation section so as to calculate an optimal value; and a control section to specify a beginning position of a second in the time code based on the estimated waveform data indicating the optimal value;

Another object of the present invention is achieved by a time information obtaining device comprising:

a reception section to receive a standard time radio wave;

an input waveform data generation section to generate a plurality of pieces of input waveform data having one or more unit of time length, based on data having the unit of time length, wherein the data comprises a value which is obtained by sampling a signal including a time code output from the reception section, from a beginning position of a second in a predetermined sampling period and by each sample point being described by a plurality of bits, and wherein the unit of time length is a tune corresponding to one code which configures the time code;

an estimated waveform data generation section to generate estimated waveform data having a plurality of units of time length, wherein the estimated waveform data comprises the value in which each sample point is described by the plurality of bits the estimated waveform data has the same time length as the input waveform data, and a waveform of the estimated waveform data comprises a beginning position of a minute in the time code;

a correlation value calculation section to calculate a correlation value of each of the plurality of pieces of input waveform data and the estimated waveform data;

a correlation value comparison section to compare the correlation value calculated by the correlation value calculation section so as to calculate an optimal value; and a control section to specify the beginning position of the minute in the time code based on the input waveform data indicating the optimal value.

Still another object of the present invention is achieved by a time information obtaining device comprising:

a reception section to receive a standard time radio wave;

an input waveform data generation section to generate input waveform data having one or more unit of time length, the input waveform data comprising at least one code indicating a value which configures any one of a year, a month, a day, a day of week, an hour, and a minute, in a signal including a time code output from the reception section;

an estimated waveform data generation section to generate a plurality of pieces of estimated waveform data, wherein the estimated waveform data comprises a value in which each sample point is described by a plurality of bits, the estimated waveform data has the same time length as the input waveform data, and indicates a possible value of the input waveform data;

a correlation value calculation section to calculate a correlation value of the input waveform data and each of the plurality of pieces of estimated waveform data;

a correlation value comparison section to compare the correlation value calculated by the correlation value calculation section so as to calculate an optimal value; and a control section to determine the value of the estimated waveform data indicating the optimal value to be the value indicating the at least one code.

Still another object of the present invention is achieved by a radio clock comprising:

the time information obtaining device;

a decoding section to obtain the value of the code including the day, the hour, the minute which configure the time code, according to the value indicated by the code, calculated by the time information obtaining device;

a present time calculation section to calculate a first present time based on the value of the code obtained by the decoding section;

an internal timing section to time a second present time by an internal clock;

a time correction section to correct the second present time timed by the internal timing section, based on the first present time obtained by the present time calculation section; and a time display section to display the second present time timed by the internal timing section or the second present time which has been corrected by the time correction sect ion based on the first present time.

DETAILED DESCRIPTION OF THE PREFERRED EMBODIMENTS

Hereinbelow, the embodiments of the present invention are described with reference to the attached drawings. In the embodiments, a time correction device according to the present invention is provided in a radio clock in which the standard time radio wave of a long wave hand is received; a signal thereof is detected; a sequence of codes indicating a time code which is included in the detected signal is extracted; and the time is corrected based on the sequence of the codes.

Presently, in countries such as Japan, Germany, the United Kingdom, Switzerland, and the like, the standard time radio wave is transmitted from predetermined transmitting stations For example, in Japan, standard time radio waves of 40 kHz and 60 kHz, which are performed with an amplitude modulation, are transmitted from a transmitting station located in Fukushima prefecture and in Saga prefecture, respectively The standard time radio wave contains a sequence of codes which configure a time code indicating year/month/day/hour/minute, so that the time code is transmitted in 60 seconds per 1 period. Since 1 code takes a unit of time length (1 second), 1 period may contain 60 codes.

Figure 1:
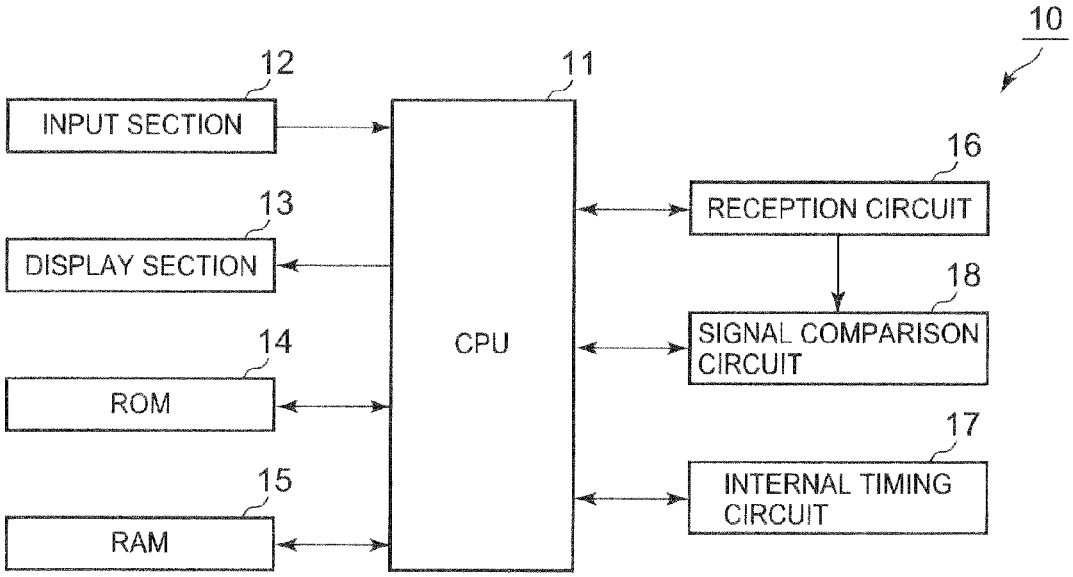
FIG. 1 is a block diagram showing a configuration of a radio clock according to the present embodiment.

FIG. 1 is a block diagram showing the configuration of the radio clock according to the present embodiment. As shown in FIG. 1, the radio clock 10 comprises a central processing unit (CPU) 11, an input section 12, a display section 13, a read only memory (ROM) 14, a random access memory (RAM) 15, a reception circuit 16, an internal timing circuit 17, and a signal comparison circuit 18.

The CPU 11 reads programs stored in the ROM 14 at a predetermined timing, or according to an operation signal input from the input section 12. Further, the CPU 11 expands the read programs in the RAM 15 to execute an instruction and data transmission to each section which configures the radio clock 10, based on the expanded programs. To put it concretely, for example, the CPU 11 controls the reception circuit 16 for every predetermined length of time so that the reception circuit 16 receives the standard time radio wave. Further, the CPU 11 specifies the sequence of the codes included in the standard time radio wave signal among digital data based on the signal obtained by the reception circuit 16, to execute processing of correcting the present time measured by the internal timing circuit 17 based on the specified sequence of the codes, and processing of transmitting the present time measured by the internal timing circuit 17 to the display section 13, and the like.

In the present embodiment, estimated code data including predetermined codes, having 1 or more units of time length, is generated. The generated estimated code data is compared with input waveform data which is obtained from the standard time radio wave received by the reception circuit 16, thereby the values of the beginning of a second; the beginning of a minute; various codes including hour, minute, year/month/day, are specified. The year/month/day and the hour/minute are specified, thereby errors it the internal timing circuit 17 are calculated, and the present, time in the internal timing circuit 17 is corrected.

The input section 12 comprises a switch to instruct an execution of various functions of the radio clock 10. When the switch is operated, the input section 12 outputs the corresponding operation signal to the CPU 11. The display section 13 comprises an analog gnomon mechanism which is controlled by a dial plate and CPU 11; and a liquid crystal panel, and displays the present time measured by the Internal timing circuit 17. The ROM 14 stores system pro-rams and application programs to operate the radio clock 10 and to realize predetermined functions.

The programs to realize the predetermined functions include a program to control the signal comparison circuit 18 for detection processing of a second pulse; detection processing of a minute beginning position; and obtaining (decoding) processing of values indicating various codes, which will be described later. The RAM 15 is utilized as a working area of the CPU 11, and temporarily stores the programs and data read by the ROM 14, and data processed by the CPU 11.

The reception circuit 16 comprises an antenna circuit and a detection circuit, and the like. The reception circuit 16 obtains a signal demodulated from the standard time radio wave received by the antenna circuit to output the obtained signal to the signal comparison circuit 18. The internal timing circuit 17 comprises an oscillation circuit and times the present time by measuring the clock signal output from the oscillation circuit so as to output the data of the measured present time to the CPU 11.

Figure 2:
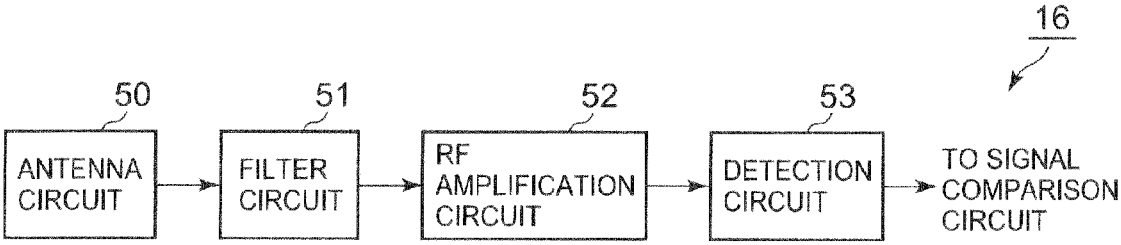
FIG. 2 is a block diagram showing a configuration example of a reception circuit according to the present embodiment.

FIG. 2 is a block diagram showing the configuration example of the reception circuit 16 according to the present embodiment. As shown in FIG. 2, the reception circuit 16 comprises an antenna circuit 50 to receive the standard time radio wave; a filter circuit 51 to remove noises from a signal of the standard time radio wave (a standard time radio wave signal) received by the antenna circuit 50; an RF amplification circuit 52 to amplify a high-frequency signal which is the output of the filter circuit 51; and a detection circuit 53 to detect the signal output from the RF amplification circuit 52 and to demodulate the standard time radio wave signal. The signal demodulated by the detection circuit 53 is output to the signal comparison circuit 18.

Figure 3:
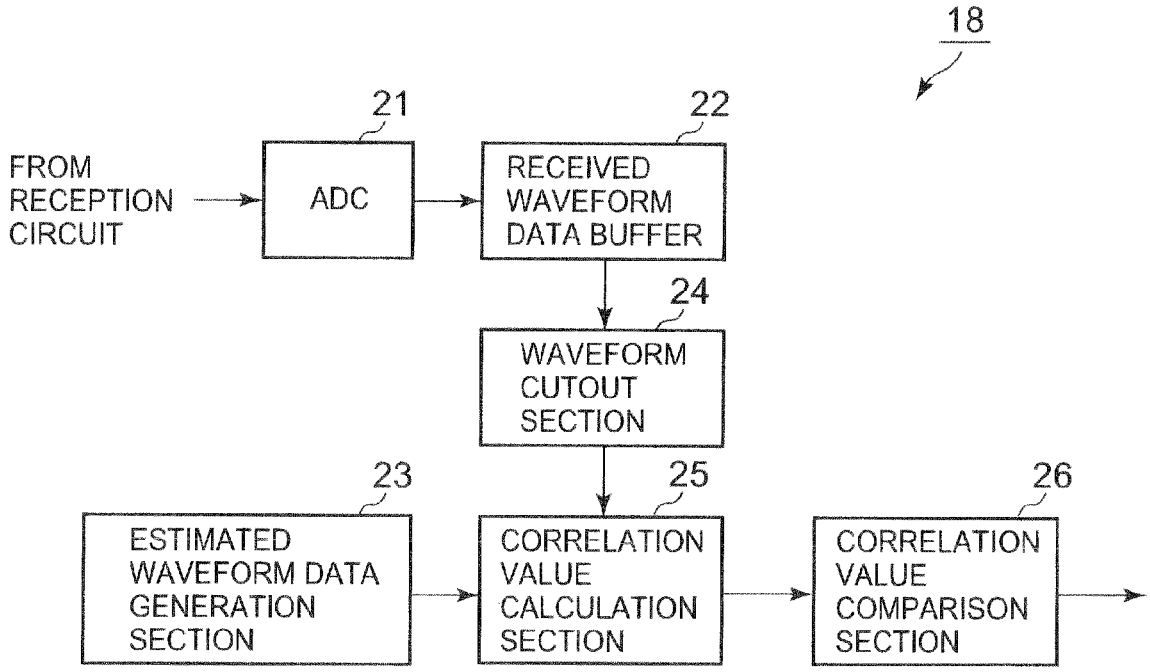
FIG. 3 is a block diagram showing a configuration of a signal comparison circuit according to the present embodiment.

FIG. 3 is a block diagram showing the configuration of the signal comparison circuit 18 according to the present embodiment. As shown in FIG. 3, the signal comparison circuit 18 according to the present embodiment comprises an AD converter (ADC) 21; a received waveform data buffer 22; an estimated waveform data generation section 23; a waveform cutout section 24; a correlation value calculation section 25; and a correlation value comparison section 26.

The ADC 21 converts the signal output from the reception circuit 16 to digital data, the value of which is described by a plurality of bits, so as to output the digital data at a predetermined sampling interval. For example, the above mentioned sampling interval is 50 ms, and thereby data of 20 samples can be obtained per 1 second. The received waveform data buffer 22 sequentially stores the data. The received waveform data buffer 22 can store data of a plurality of unit of time length (1 second each) (for example data of 10 units of time (10 seconds)), and when data is to be further stored, data is deleted in order from the old ones.

The estimated waveform data generation section 23 generates estimated waveform data having a predetermined time length, to be an object of the comparison, which is used in each of the processing described later. The estimated waveform data which is generated in the estimated waveform data generation section 23 will be described in detail in each of the processing. The waveform cutout section 24 extracts the input waveform data having the time length which is the same as that of the estimated waveform data, from the received waveform data buffer 22.

The correlation value calculation section 25 calculates the correlation value of each of the plurality of pieces of the estimated waveform data, and the input waveform data. The present embodiment employs a covariance value in order to obtain the correlation, as described later. The correlation value comparison section 26 compares the correlation values calculated by the correlation value calculation section 25 to specify the optimal value thereof.

Figure 4:
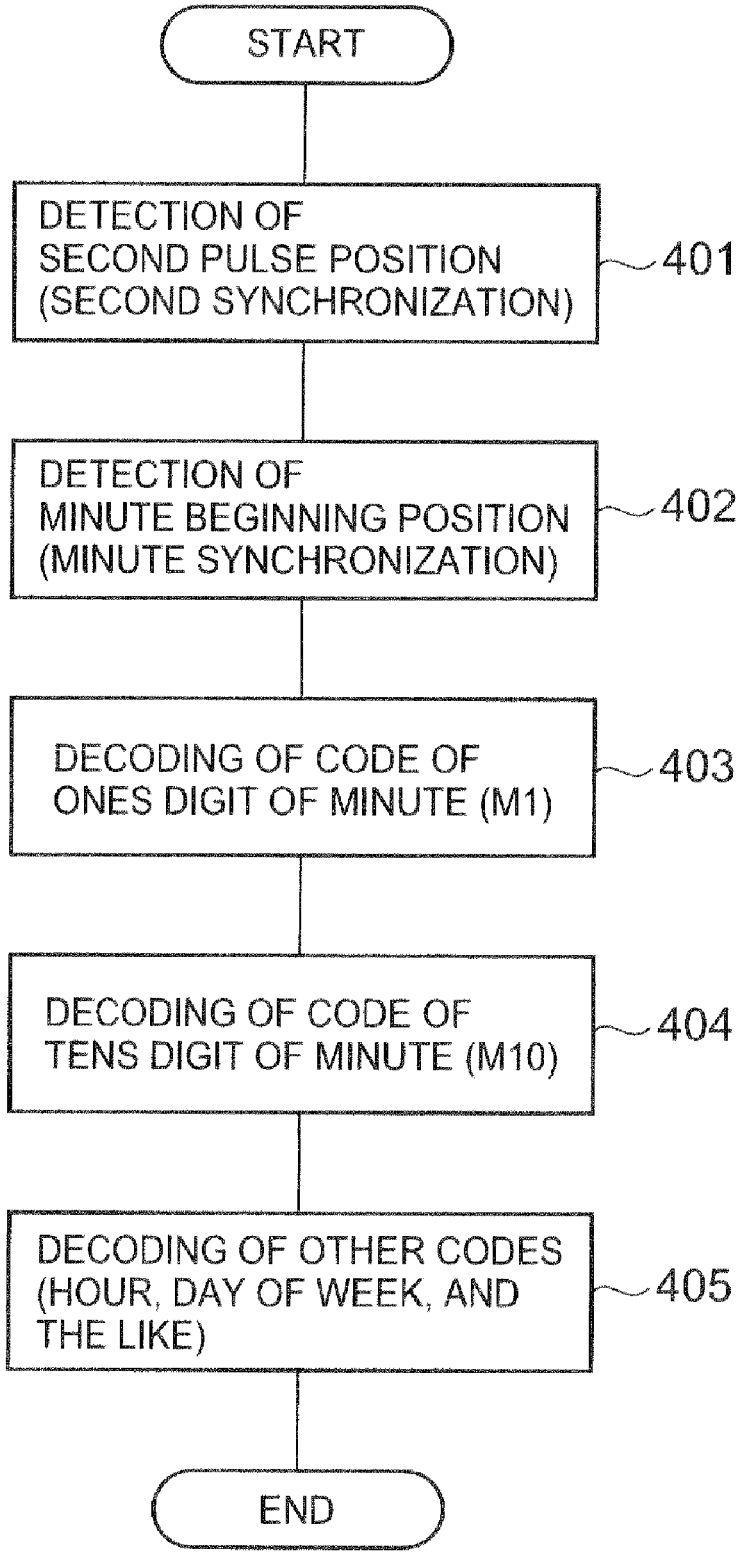
FIG. 4 is a flow chart showing an outline of the processing executed in the radio clock according to the present embodiment.

FIG. 4 is a flow chart showing the outline of the processing executed in the radio clock according to the present embodiment. The processing shown in FIG. 4 is executed mainly by the CPU 11 and the signal comparison circuit 18 based on the instruction of the CPU 11.

As shown in FIG. 4, the CPU 11 and the signal comparison circuit 18 (hereinbelow, referred to as "the CPU 11, and the like" for convenience) detect the second pulse position (step 401).

Figure 5:
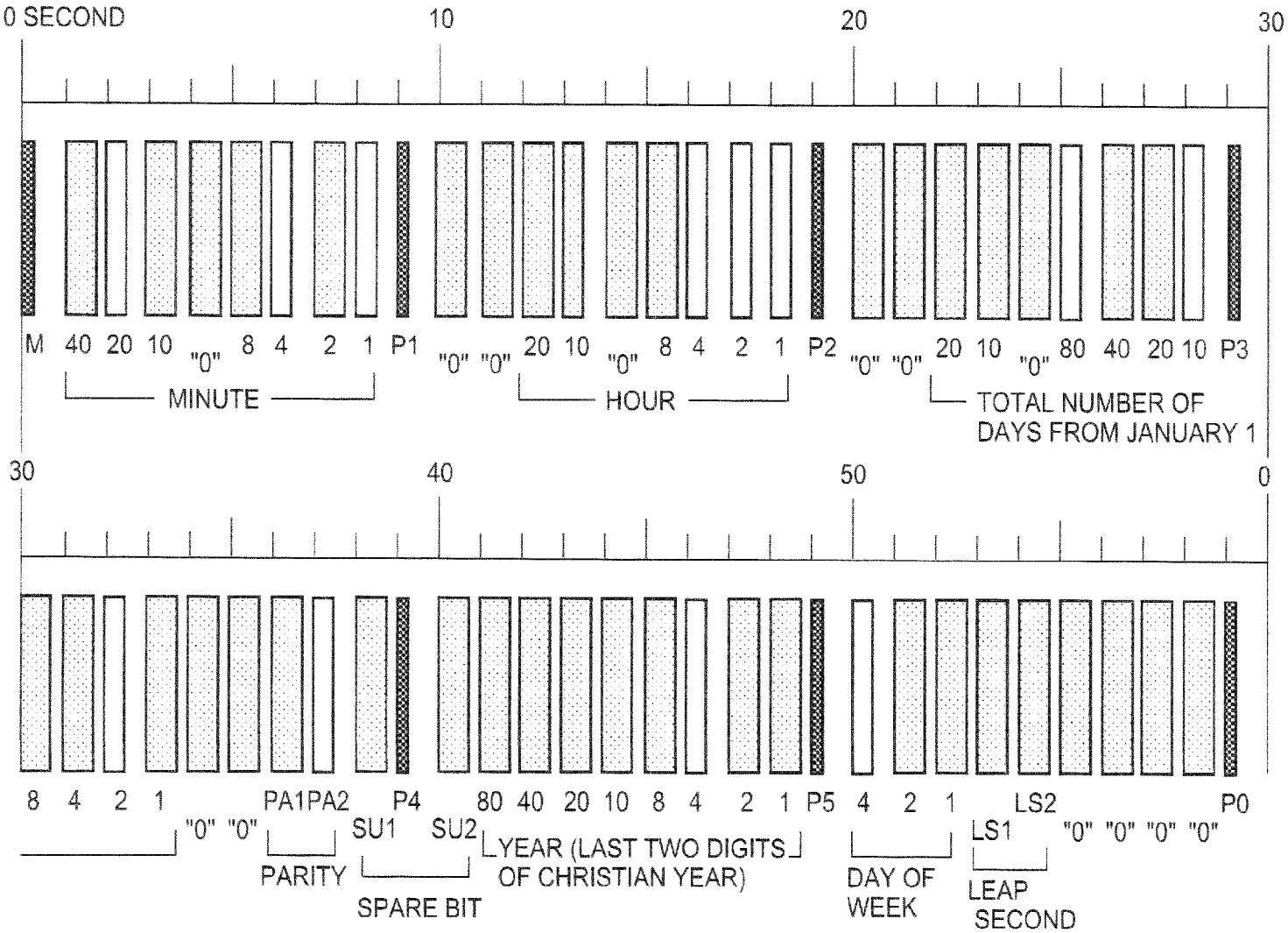
FIG. 5 is a diagram illustrating a format of a standard time radio wave signal.

FIG. 5 is a diagram illustrating the format of the standard time radio wave signal. As shown in FIG. 5, the standard time radio wave signal is transmitted in a predetermined format. In the standard time radio wave signal, the codes indicating "P", "1", and "0" of a unit of time length of 1 second, are in sequence. In the standard time radio wave, 60 seconds configure 1 frame, and 1 frame comprises 60 codes. Further, in the standard time radio wave, position markers "P1", "P2", . . . , or markers "M" arrive every 10 seconds. Further, by detecting the portion where the position marker "P0" positioned at the ending of a frame, and the marker "M" positioned at the beginning of the frame are continued, one can detect the beginning of the frame which arrives every 60 seconds, that is to say, the beginning portion of a minute.

As shown in FIG. 5, in the codes of a unit of time length, the code "P" has 20% of duty (in which the first 20% is of a high-level, and the remaining 80% is of a low-level); the code "1" has 505 of duty; and the code "0" has 805 of duty. In the present embodiment, the pieces of code data having duty 805 which correspond to the code "1" are continued by a predetermined number thereof, and a plurality of pieces of estimated waveform data in which each of the pieces of code data is shifted by 50 nm is generated, as will be described later.

In this manner, the correlation values of the plurality of pieces of estimated waveform data and the input waveform data are calculated, and the second pulse position (the beginning position of a second) is judged to be the timing at which the estimated waveform data indicating the optimal correlation value rises from a low-level to a high-level.

Subsequently, the CPU 11, and the like, detect the beginning position of a minute, that is to say, the beginning position of the standard time radio wave signal of 1 frame, as mentioned above (step 402). Also in step 402, in the present embodiment, the estimated waveform data having 2 units of time length, in which 2 codes of "P" are continuous is generated, so as to calculate the correlation value of the estimated waveform data and the plurality of pieces of input waveform data. The processing in step 402 will also be described later.

Subsequently, the CPU 11, and the like, decode various codes (the code of a ones digit of a minute (M1), the code of a tens digit of a minute (M10), and other codes of day/hour, day of week, and the like) of the standard time radio wave signal, based on the comparison of the estimated waveform data and the input waveform data (step 403-405). The decoding processing (which is the detection processing of the values) will also be described later.

Figure 6:
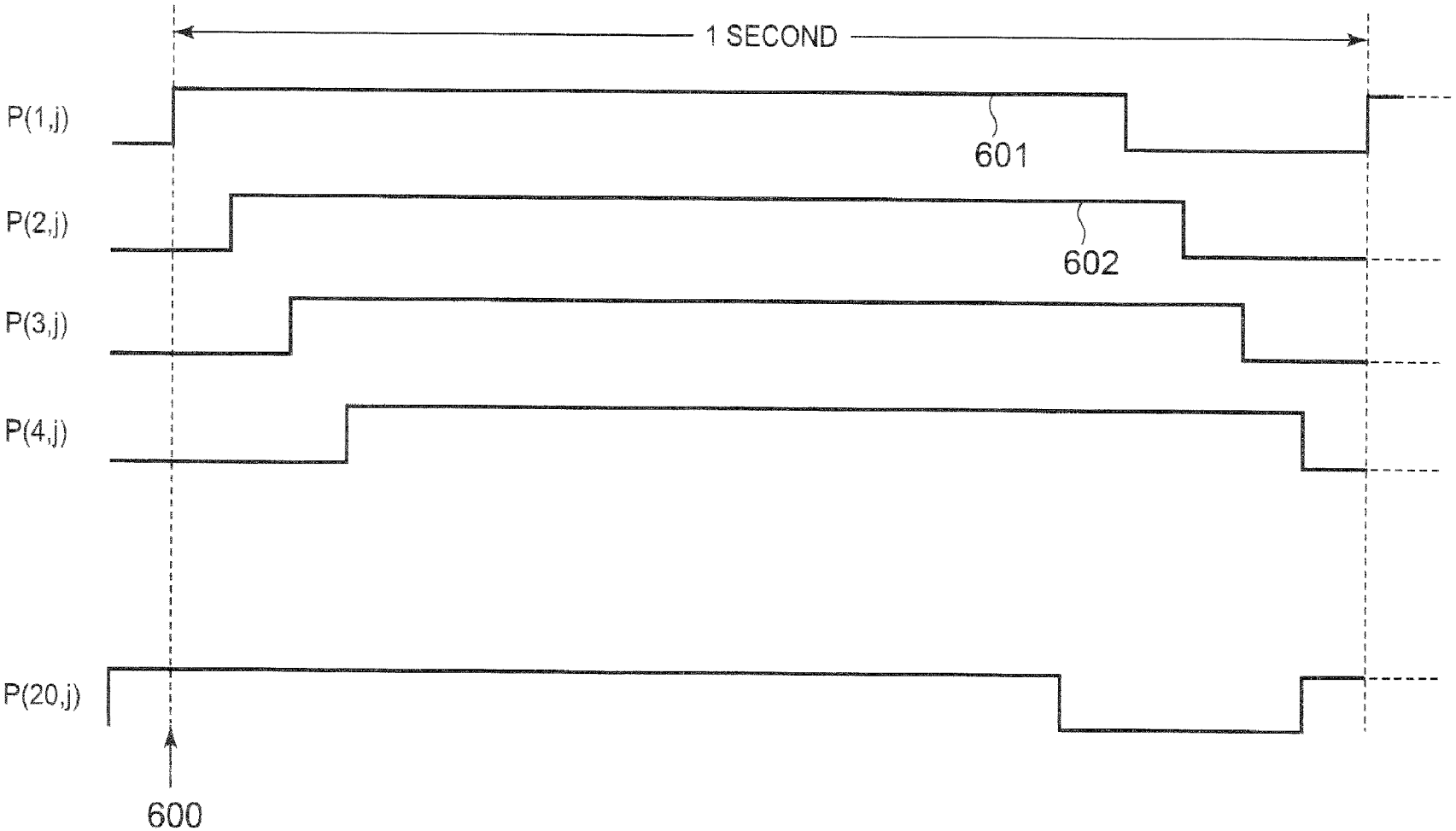
FIG. 6 is a diagram exemplifying a portion of estimated waveform data which is used in a second synchronization according to the present embodiment.

Subsequently, the detection processing (step 401) of the second pulse position according to the present embodiment is described in detail. The processing in step 401 is also referred to as the second synchronization. FIG. 6 is a diagram exemplifying the portion of the estimated waveform data which is used in the second synchronization according to the present embodiment. In FIG. 6, a part for 1 second which corresponds to the first unit of time length of respective pieces of the estimated waveform data is described. The broken line indicated by the reference number 600 represents the beginning of the estimated waveform data.

Practically, in the present embodiment, data having 4 units of time length in which 4 pieces of data having the code "0" of a unit of time length are continuous as shown in FIG. 6, that is to say, the estimated waveform data for 4 seconds, is generated by the estimated waveform data generation section 23. Further, in the present embodiment, 20 pieces of estimated waveform data P(1,*j*)-P(20,*j*) are generated by the estimated waveform generation section 23, in which each position of the beginning of the code "0" (where the rising from the low-level to the high-level arrives) is respectively shifted by 50 ms each.

As shown in FIG. 6, the first estimated code data P(1,*j*) (refer to reference number 601) rises from the low-level to the high-level at the beginning of the data (refer to reference number 600). The second estimated code data P(2,*j*) (refer to reference number 602) rises from the low-level to the high-level at a position where 50 ms lapsed from the beginning of the data. The rising positions from the low-level to the high-level of the third estimated code data P(3,*j*), the fourth estimated code data P(4,*j*), . . . , are thereafter shifted further later by a position corresponding to 50 ms each.

Figure 7:
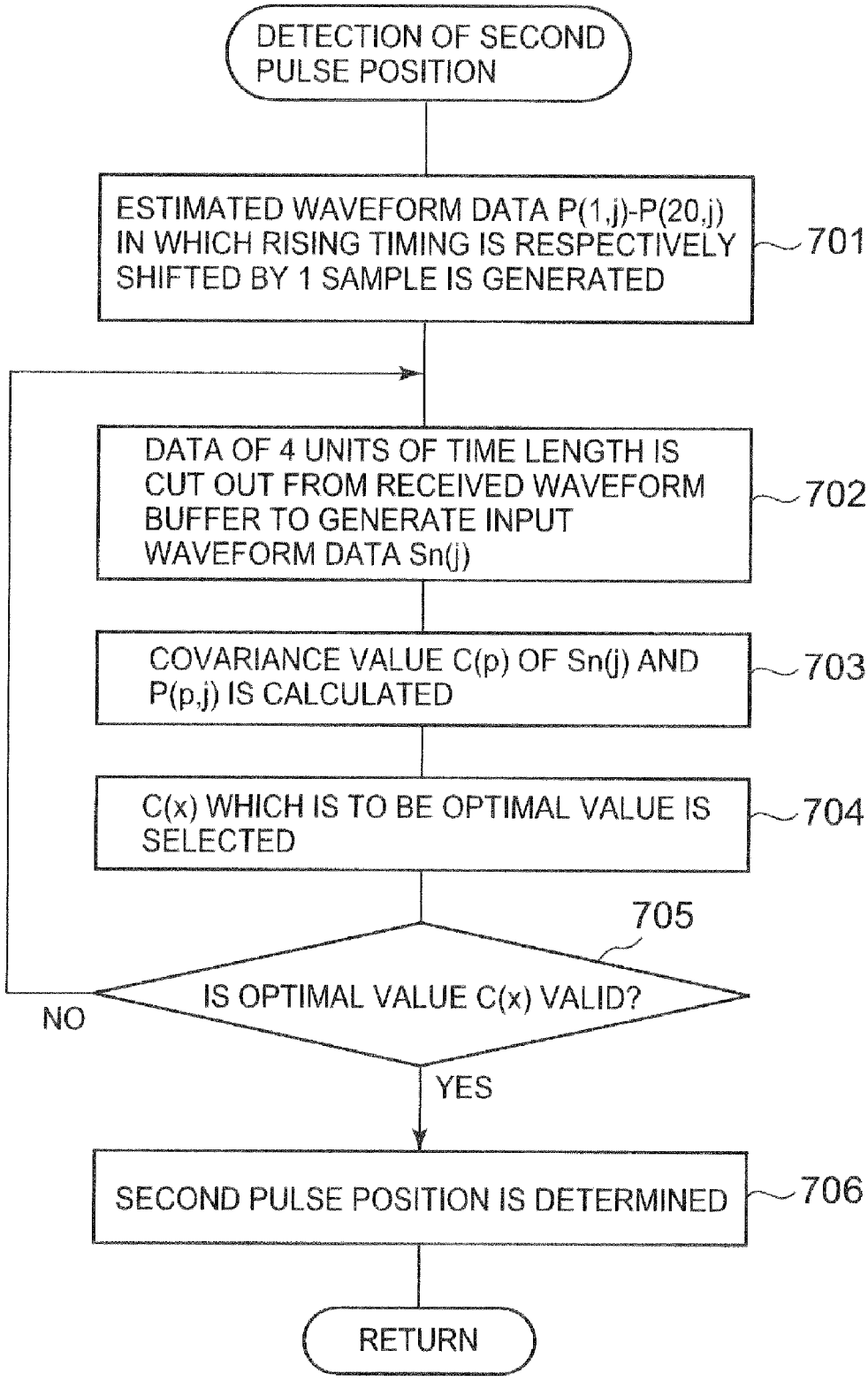
FIG. 7 is a flow chart showing a detection (the second synchronization) of a second pulse position in detail according to the present embodiment.
Figure 8:
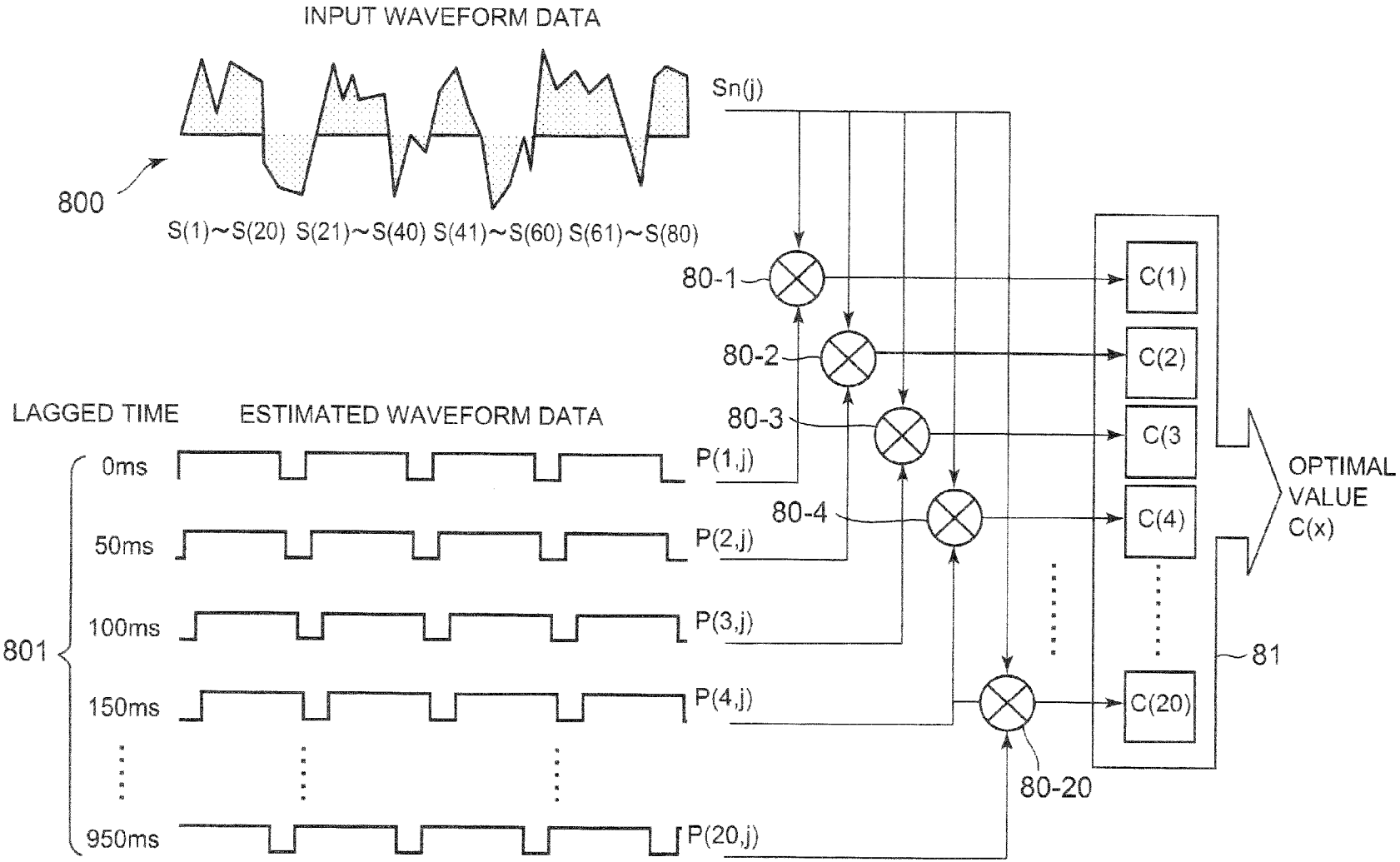
FIG. 8 is a diagram schematically showing detection processing of the second pulse position according to the present embodiment.

FIG. 7 is a flow chart showing the detection (the second synchronization) of the second pulse position in detail according to the present embodiment. Further, FIG. 8 is a diagram schematically showing the detection processing of the second pulse position according to the present embodiment. As shown in FIG. 7, the estimated waveform data generation section 23 generates 20 pieces of estimated waveform data P(1,*j*)-P(20,*j*) of 4 units of time length (4 seconds), in which each position of the beginning of the code "0" (where the rising from the low-level to the high-level arrives) is respectively shifted by 50 ms each, according to the instruction of the CPU 11 in the above described manner (step 701, reference number 801 in FIG. 8).

Subsequently, the waveform cutout section 24 cuts out data of 4 units of time length (4 seconds) from the reception waveform data buffer 22, so as to generate input waveform data Sn(j), according to the instruction of the CPU 11 (step 702, reference number 800 in FIG. 8) As shown in FIG. 8, in the present embodiment, 20 samples of data is obtained per 1 second, thus Sn(j) is data including 80 samples. Incidentally, in order to speed up the processing, or to reduce the size of the received waveform data buffer 22, the waveform cutout section 24 may extract sample data sequentially in an order of Sn(1), Sn(2), . . . , in a state where not all of the data of 4 units of time length is stored in the received waveform data buffer 22.

Subsequently, the correlation value calculation section 25 calculates the correlation value (the covariance value) C(p) (p=1–20) between the input waveform data Sn(j) and the estimated waveform data P(p,j), according to the instruction of the CPU 11 (step 703). In the present embodiment, the correlation value calculation section 25 calculates the covariance value C(p) accord rig to the following formulae by using the input waveform data Sn(j), the mean value thereof Sm, the estimated waveform data P(p,j), and the mean value thereof Pm. In FIG. 8, the reference numbers 80-1 to 80-20 respectively indicate a covariance value calculation section.

$$C(p)=(1/N)\times\Sigma((Sn(j)-Sm)\times(P(p,j)-Pm)$$

$$Sm=(1/N)\times\Sigma(Sn(j)$$

$$Pm=(1/N)\times\Sigma(P(p,j)$$

Incidentally, Σ is for j=1–N. Further, as described above, in a case where the waveform cutout section 24 sequentially extracts sample data in an order of Sn(1), Sn(2), . . . , not all of the Sn(j) (j=1–N) is obtained at the beginning of step 703. Accordingly, at, the beginning stage of step 703, the mean value Sm=(1/N)×Σ(Sn(j)) cannot be obtained.

However, the above C(p) can be deformed as follows.

$$C(p)=(1/N)\Sigma(Sn(j)\times P(p,j))-Sm\times Pm$$

Accordingly, each time the waveform cutout section 24 obtains the sample data Sn(j), the correlation value calculation section 25 may calculate Sn(j)×P(p,j), and may repeat accumulating the multiplication results to the addition results. When the last sample data Sr(N) is obtained, the correlation value calculation section 25 may calculate the mean value Sm to reduce Sm×Pm from the accumulation results.

When all of the correlation values (covariance values) C(1)-C(20) have been obtained, the correlation value comparison section 26 compares the correlation values C(1)-C(20), so as to detect the optimal value C(x) (in this case, the maximum value) (refer to step 704, reference number 81 in FIG. 8). The CPU 11 accepts the optimal value C(x) to judge whether the optimal value is valid or not (step 705).

When the covariance value is obtained from insufficient samples of population, although the C(x) indicating the maximum value among the obtained covariance values C(p) is supposed to be the waveform having the highest correlation, the obtained maximum value may appear by an accidental factor by some noises. In order to eliminate such cases, for example, a false detection may be avoided by providing the following judgment criteria in step 705.

(1) The number of pieces of input, waveform data used for the covariance value calculation is no less than a predetermined number.

(2) The values of "x" indicating C(x) appear for a plurality of times, the values of "x" are equal for the plurality of times, and the frequency is more than other values ("x" is the mode value).

(3) The value of "x" is equal continuously for no less than a predetermined number of times (the sequence of the mode value).

Incidentally, a group of processing of steps 702-704 in FIG. 7 is to be executed for a plurality of number of times when judging the above (1)-(3).

(4) The variance of C(p) is no more than a defined value.

(5) A kurtosis or a degree of distortion which is a statistics value of the C(p), or another evaluation function is calculated, and whether the results thereof reaches a defined value is judged.

Of course, the judgment of validity is not limited to the above mentioned method. For example, by using the mean value or the standard deviation of the correlation value, even the local maximum value of the correlation value may be judged to be insignificant as long as it is less than the mean value. Alternatively, a general significance level (for example, 5%) in statistics may be used Where the optimal value C(x) is valid (Yes in step 705), the CPU 11 judges the beginning position of the code "0" indicating the optimal value C(x), that is to say, the rising position from the low-level to the high-level, to be the second pulse position (step 706). The CPU 11 stores the information pertaining to the second pulse position in the RAM 15. The second pulse position is used in the processing of detection of the minute beginning position, and the like, which will be described below.

Figure 9:
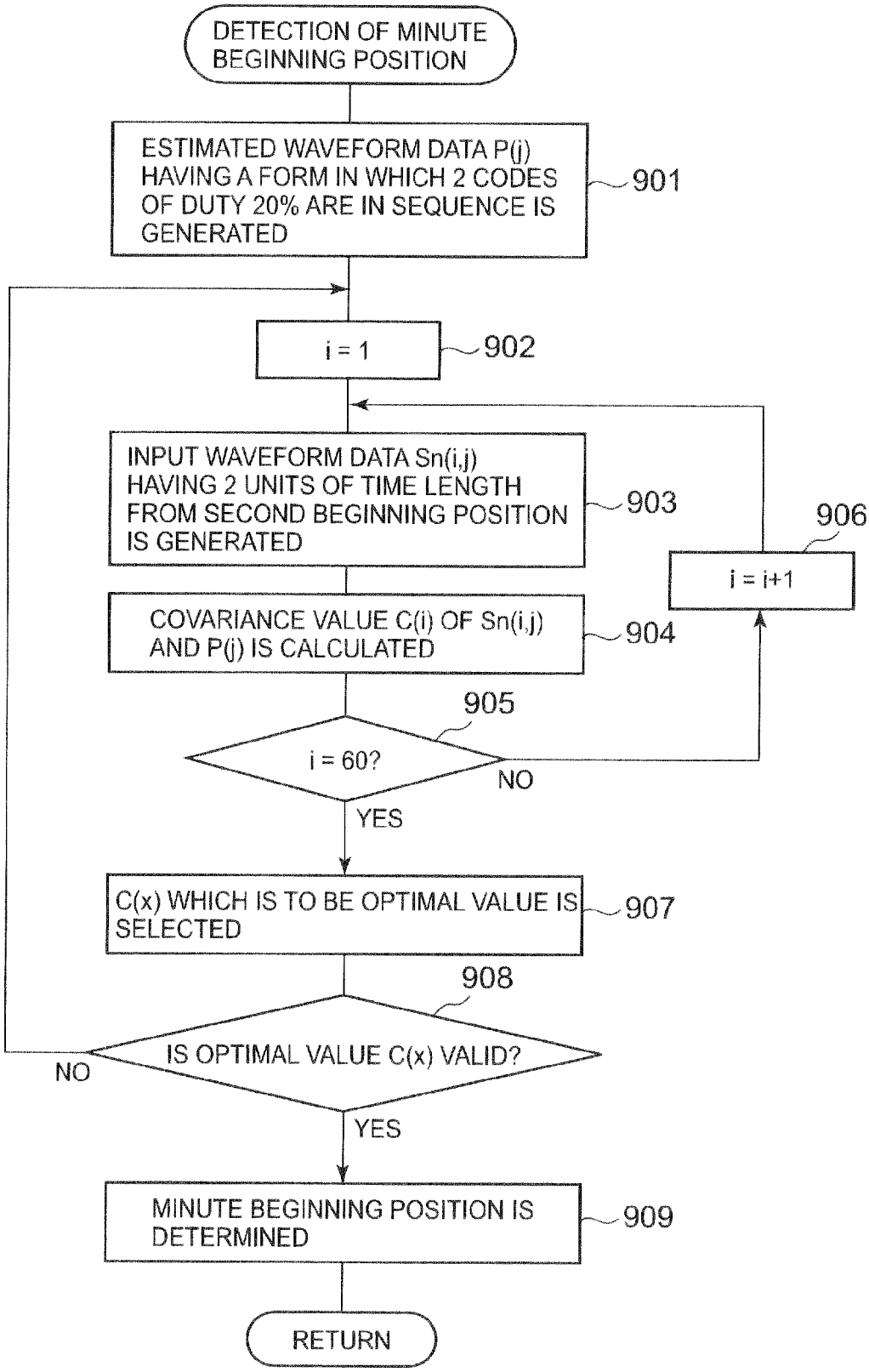
FIG. 9 is a flow chart showing a detection (the minute synchronization) of a minute beginning position in detail according to the present embodiment.

Subsequently, the detection of the minute beginning position is described in detail. The detection of the minute beginning position is also referred to as the minute synchronization. FIG. 9 is a flow chart showing the detection (the minute synchronization) of the minute beginning position in detail according to the present embodiment. The second pulse position (the beginning position of the second) has already been determined by the second synchronization. Further, as shown in FIG. 5, before and after the minute beginning position (60 seconds and 1 second), the code "P" of duty 20% is continuous. Thus, in the minute synchronization, the estimated waveform data of 2 units of time length in a state where the code "P" of duty 20% is continuous is generated. Further, 60 pieces of input waveform data of 2 units of time length (2 seconds), each of which starting from the second pulse position (the second beginning position), are generated The correlation values are calculated from the estimated waveform data and the 60 pieces of input waveform data, respectively, so that 60 correlation values (covariance values) C(1)-C(60) can be obtained.

Figure 10:
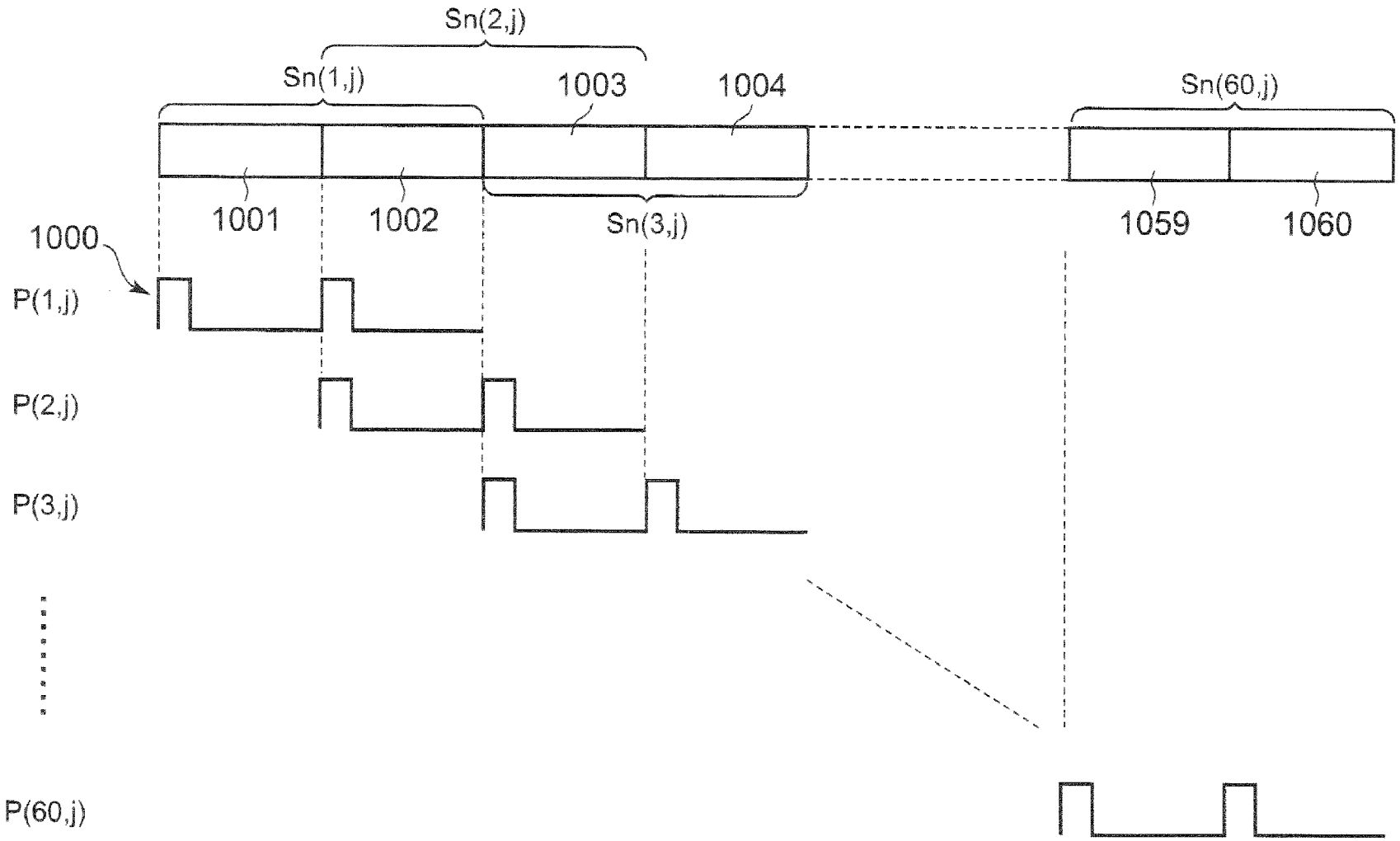
FIG. 10 is a diagram showing an outline of input waveform data and the estimated waveform data in the detection processing of the minute beginning position according to the present embodiment.

As shown in FIG. 9, the estimated waveform data generation section 23 generates the estimated waveform data P(j) of 2 units of time length in the state where the 2 pieces of code data of duty 20% is continuous, according to the instruction of the CPU 11 (step 901). As shown in FIG. 10, the estimated waveform data (refer to reference number 1000) is in a state where 2 waveforms, in which the first 200 ms (20%) is of a high-level, and the remaining part is of a low-level in a unit of time length (1 second), are in sequence.

Subsequently, a parameter "i" to specify the second beginning position is initialized, and the waveform cutout section 24 obtains the input waveform data Sn(i,j) of 2 units of time length (2 seconds) in the second beginning position from the received waveform data buffer 22, according to the instruction of the CPU 11 (step 903). The correlation value calculation section 25 calculates the correlation value (the covariance value) C(i) of the input waveform data Sn(i,j) and the estimated waveform data P(j) (step 904). The calculation of the covariance value is performed in the same manner as in the second synchronization processing, thus the description thereof is omitted.

The CPU 11 judges whether the parameter "i" is 60 or not (step 905), and when it is judged to be No in step 905, the parameter "i" is incremented (step 906). In the following step 903, the waveform cutout section 24 obtains the input waveform data Sn(i,j) of 2 units of time length (2 seconds) in the next second beginning position (that is to say, a position located after the second beginning position of the previous input waveform data by 20 samples), according to the instruction of the CPU 11. The covariance values are thereafter calculated for the newly obtained input waveform data Sn(i,j) and the estimated waveform data P(j).

FIG. 10 is a diagram showing the outline of the input waveform data and the estimated waveform data in the detection processing of the minute beginning position according to the present embodiment. As shown in FIG. 10, the input waveform data Sn(1,*j*) comprises data of 1001 and 1002 which is 2 units of time length from a certain second beginning position. The next input waveform data Sn(2,*j*) comprises data of 1002 and 1003 which is 2 units of time length from the next second beginning position. In this manner, Sn(n−1,*j*) and Sn(n,j) are data in a state where the second beginning position is shifted by a unit of time length (1 second). The ending input waveform data Sn(60,*j*) comprises data of 1059 and 1060 which is 2 units of time length, and which is shifted from the beginning input waveform data Sn(1,*j*) by 59 seconds.

The covariance values are calculated for the input waveform data S(1,*j*), S(2,*j*), S(3,*j*), . . . , S(60,*j*), and the estimated waveform data, respectively. In FIG. 10, the estimated waveform data with which the covariance values are calculated from Sn(1,*j*), Sn(2,*j*), Sn(3,*j*), . . . , Sn(60,*j*), is described as P(1,*j*), P(2,*j*), P(3,*j*), . . . , P(60,*j*), for convenience of illustration, however the estimated waveform data actually has the same value P(j).

When all of the correlation values (covariance values) C(1)-C(60) have been obtained, the correlation value comparison section 26 compares the correlation values C(1)-C(60), so as to detect the optimal value C(x) (in this case, the maximum value) (step 907). The CPU 11 accepts the optimal value C(x) to judge whether the optimal value is valid or not (step 908). The judgment whether the optimal value is valid or not is also performed in the same manner as in the second synchronization processing (step 705 in FIG. 7). When it is judged to be No in step 908, the process returns to step 902. The waveform cutout section 24 obtains another input waveform data which is different from the data used in the previous processing, stored in the received waveform buffer 22, according to the instruction of the CPU 11.

When it is judged to be Yes in step 908, the CPU 11 judges the beginning position of the second code "P", that is to say, the rising position from the second low-level to the high-level, in the input waveform data indicated by the optimal value C(x), to be the beginning position of a minute (step 909). The CPU 11 stores the information pertaining to the beginning position of a minute in the RAM 15.

Next, the decoding processing of the codes which configure the time code is described. By determining the beginning position of a minute, positions of various codes, such as year, day, day of week, hour, minute, and the like, in the time code are determined. Accordingly, codes included in the input signal waveform at a specific position are estimated, the correlation value (the covariance value) between the estimated waveform data based on the estimation and the input waveform data including the specific position of the input signal waveform is calculated. Further, the values indicating the codes such as year, day, day of week, hour, minute, and the like, included in the abovementioned time code can be determined from the values of the codes corresponding to the estimated waveform data, the correlation value of which was optimal.

First, the decoding of the ones digit of a minute (M1) is described. The ones digit of a minute comprises any one value of "0"-"9". In the time code, this is described by a BCD code of 4 bits. Thus, the estimated waveform data indicating each of "0"-"9" is generated, thereby the generated estimated waveform data may be compared with the input waveform data located at a position corresponding to the one digit of a minute.

Figure 11:
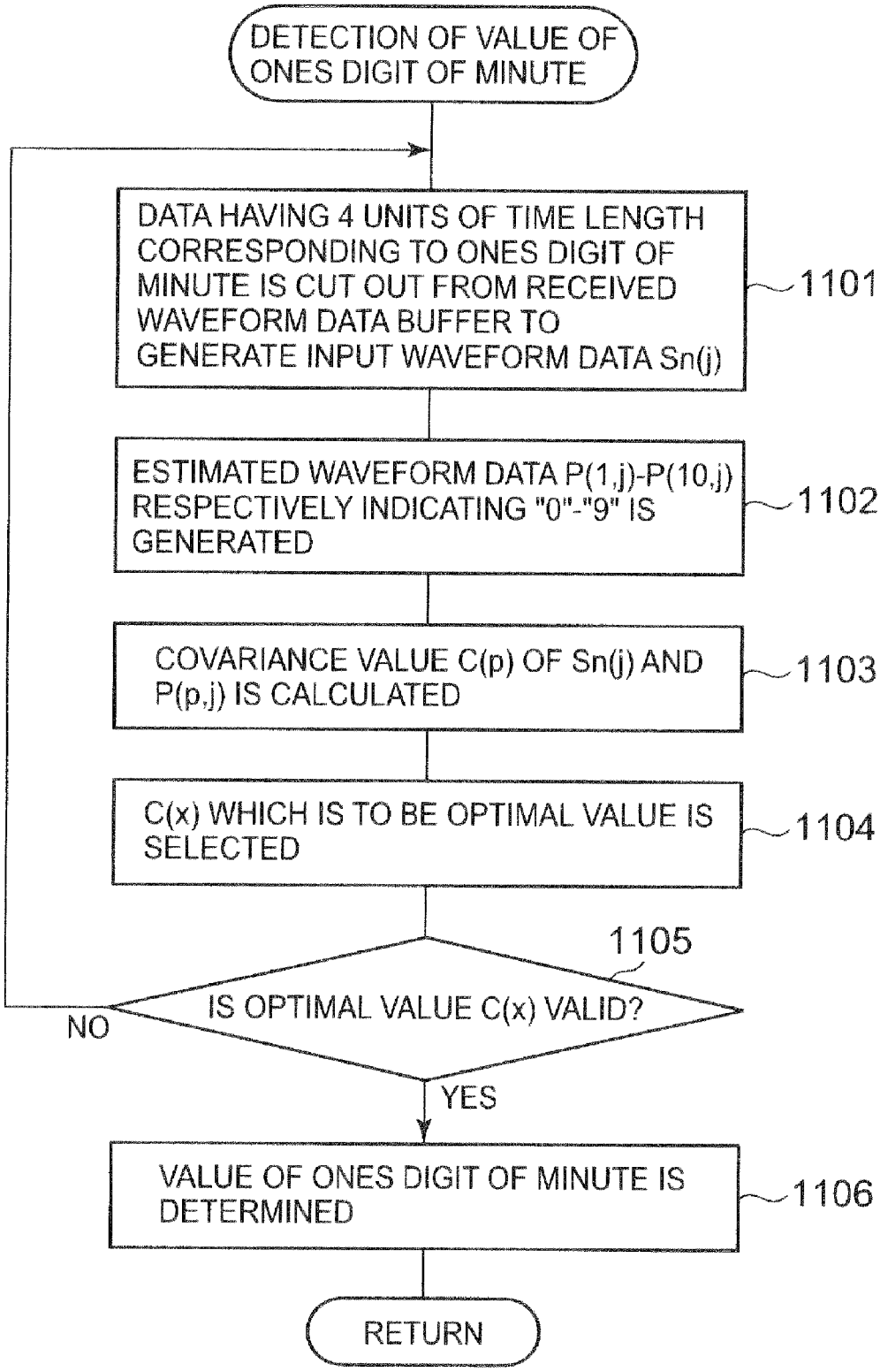
FIG. 11 is a flow chart showing the detection processing of a ones digit of a minute in detail according to the present embodiment.
Figure 12:
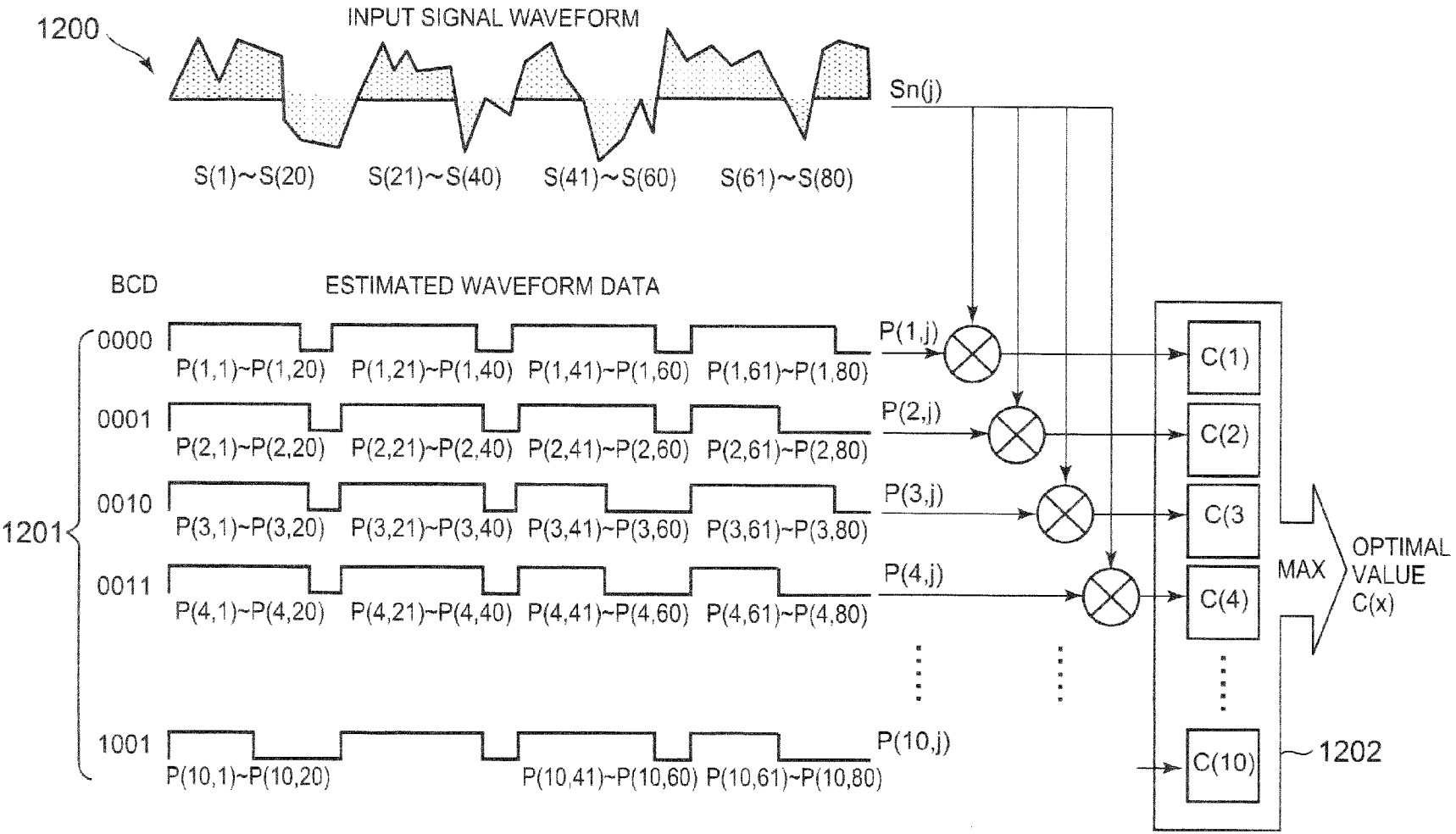
FIG. 12 is a diagram schematically showing the detection processing of the ones digit according to the present embodiment.

FIG. 11 is a flow chart showing the decoding processing of the ones digit of a minute in detail according to the present embodiment. FIG. 12 is a diagram schematically showing the above decoding processing. As shown in FIG. 11, the waveform cutout section 24 cuts out data of 4 units of time length (4 seconds) located at a position corresponding to the ones digit of a minute, from the received waveform data buffer 22, to generate the input waveform data Sn(j), according to the instruction of the CPU 11 (step 1101, reference number 1200 in FIG. 12).

Subsequently, the estimated waveform data generation section 23 generates 10 pieces of estimated waveform data P(1,*j*)–P(10,*j*), which are "0(=0000)" to "9(=1001)" in binary, having 4 units of time length according to the instruction of the CPU 11, as in the manner mentioned above (step 1102, reference number 1201 in FIG. 12).

Subsequently, the correlation calculation section 25 calculates the correlation values (covariance values) C(p) (p=1–10) between the Input waveform data Sn(j) and the estimated waveform data P(p,j), according to the instruction of the CPU 11 (step 1103, reference number 1202 in FIG. 12). When all of the correlation values (covariance values) C(1)-C(10) have been obtained, the correlation value comparison section 26 compares the correlation values C(1)-C(10), so as to detect the optimal value C(x) (in this case, the maximum value) (step 1104). The CPU 11 accepts the optimal value C(x) to judge whether the optimal value is valid or not (step 1105).

When the optimal value C(x) is valid (Yes in step 1105), the CPU 11 determines the value of the estimated code data indicating the optimal value C(x), to be the value of the ones digit of a minute (step 1106). The CPU 11 stores the value of the ones digit of a minute in the RAM 15. When it is judged to be No in step 1105, the process returns to step 1101.

Figure 13:
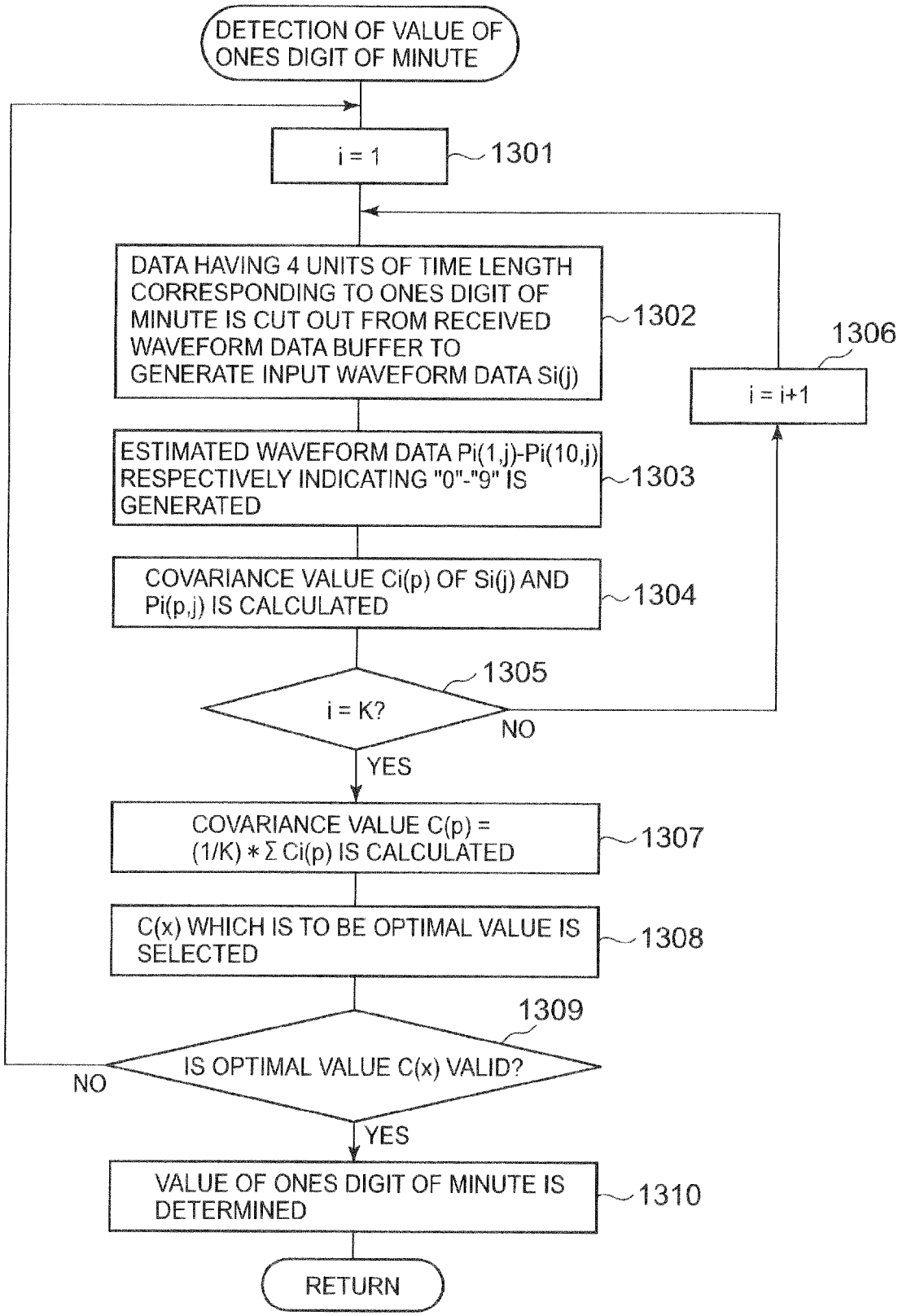
FIG. 13 is a flow chart showing detection processing of the ones digit of a minute in detail according to another embodiment of the present invention

In the example shown in FIGS. 11 and 12, a single piece of input waveform data is obtained, so as to compare it with the estimated waveform data P(1,*j*)-P(10,*j*), thereby the optimal value C(x) of the covariance value is obtained However, by using a plurality of pieces of input waveform data, and obtaining a plurality of covariance values, a further suitable matching can be realized by an accumulation effect. FIG. 13 is a flow chart showing the decoding processing of the ones digit of a minute in detail according to another embodiment of the present invention. In the example shown in FIG. 13, data having 4 units of time length corresponding to the ones digits of a minute is cut cut for K number of times, and K pieces of input waveform data Si(i)(i−1, 2, . . . , K) corresponding to the ones digit of a minute are obtained, thereby covariance values for each of them are calculated.

As shown in FIG. 13, the CPU 11 initializes the parameter "i" to specify the numbering of the input waveform data to "1" (step 1301). Subsequently, the waveform cutout section 24 cuts out data of 4 units of time length (4 seconds) located at a position corresponding to the ones digit of a minute, from the received waveform data buffer 22, to generate the input waveform data Si(j), according to the instruction of the CPU 11 (step 1302). Incidentally, the standard time radio wave is sequentially output from the reception circuit 16, and the output standard time radio wave is stored in the received waveform data buffer 22. Accordingly, the input waveform data Si(j) obtained in step 1302 which is executed at a certain processing timing is different from the input waveform data S(i+1)(j) obtained in step 1302 which is executed at the next processing timing, in that the difference in values indicating the ones digit of a minute is 1 second (the latter is larger than the former by "1").

Figure 14:
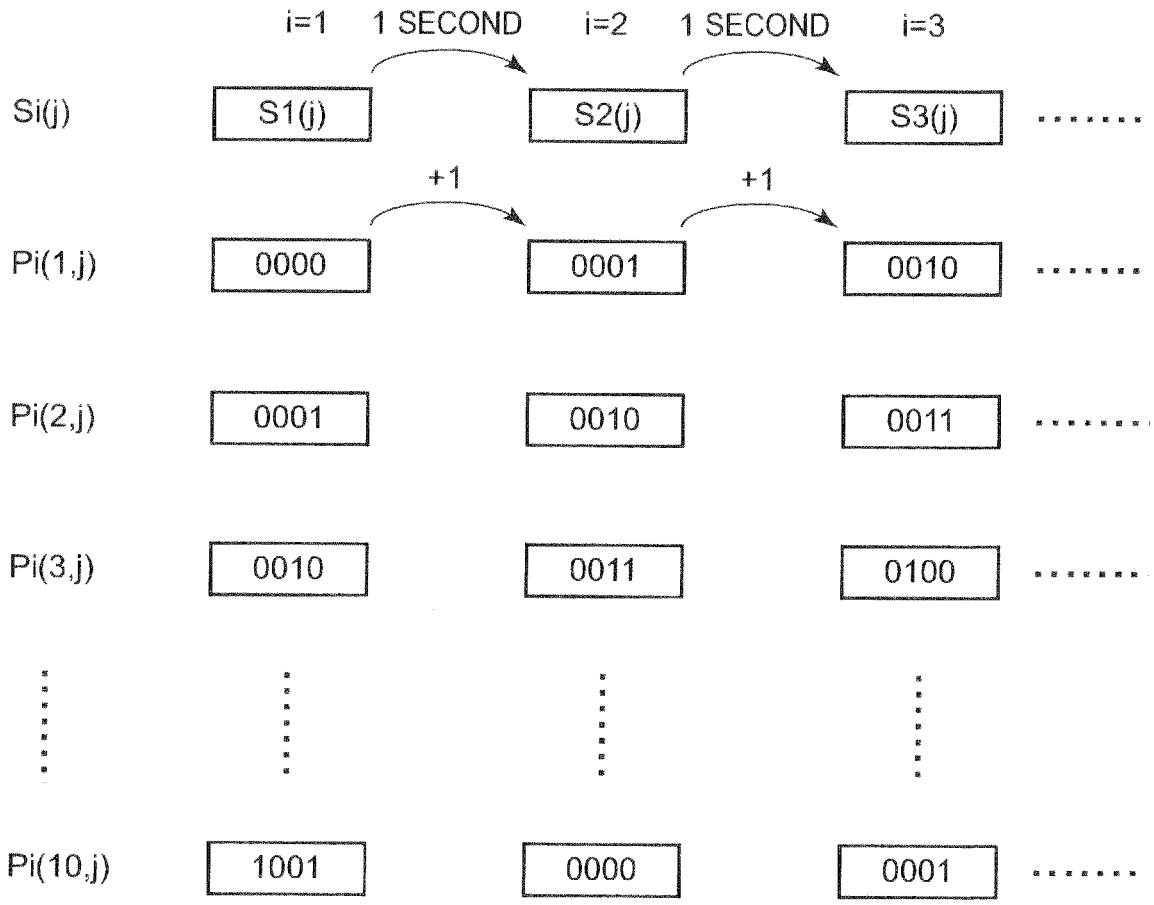
FIG. 14 is a diagram illustrating the relationship between the input waveform data Si(j) and the estimated waveform data Pi(1,j)–Pi(10,j).

Subsequently, the estimated waveform data generation section 23 generates 10 pieces of estimated waveform data Pi(1,*j*)-Pi(10,*j*) having 4 units of time length (4 seconds), based on the parameter "i" according to the instruction of the CPU 11 (step 1303) FIG. 14 is a diagram illustrating the relationship between the input waveform data Si(j) and the estimated waveform data Pi(1,*j*)-Pi(10,*j*).

As described above, when the input waveform data S1(*j*) at parameter i=1 and the input waveform data S2(*j*) at parameter i=2 are compared, the input waveform data S2(*j*) shows the value which appears 1 second later than that of the input waveform data S1(*j*). In the same mariner, when the input waveform data S2(*j*) at parameter i=2 and the input waveform data S3(*j*) at parameter i=3 are compared, the input waveform data S3(*j*) shows the value which appears 1 second later than that of the input waveform data S2(*j*). Accordingly, the estimated waveform data Pi(1,*j*)-Pi(10,*j*) which is to be the object of comparison also needs to be changed by the value corresponding to 1 second, respectively.

For example, Pi(l,*j*) is "0=0000" at parameter i=1, and when the parameter is i=1, "1" is added thereto to be "1=0001". Further, when the parameter is i=2, "1" is further added to be "2=0010". As for Pi(2,*j*), Pi(3,*j*), the value thereof is added by "1" as the parameter increases by "1", in the same manner.

Pi(10,*j*) is "9=1001" at parameter i=1, however it is to be "0=0000" when the parameter is i=1. This is because the ones digit is to be "0" when "1" is added to "9". Further, when the parameter is i=2, "1" is added to be "1=0001".

The correlation value calculation section 25 calculates the correlation value (the covariance value) Ci(p)(p=1–10) between the input waveform data Si(j) and the estimated waveform data Pi(p,j), according to the instruction of the CPU 11 (step 1304). Subsequently, the CPU 11 judges whether the parameter is i=K, or not (step 1305). When it is judged to be No in step 1305, that is to say, when the number of processing has not reached K times, the process is returned to step 1302.

On the other hand, when it is judged to be Yes in step 1305, the correlation value comparison section 26 calculates the mean value C(p)(=(1/K)×ΣCi(p)) of the covariance value Ci(P) (step 1307). When all of the mean values C(1)-C(10) of the covariance values have been obtained, the correlation value comparison section 26 compares the correlation values C(1)-C(10) so as to detect the optimal value C(x) (in this case, the maximum value) (step 1308). The CPU 11 accepts the optimal value C(x) to judge whether the optimal value is valid or not (step 1309).

When the optimal value C(x) is valid (Yes in step 1309), the CPU 11 determines the value of the estimated code data indicating the optimal value C(x), to be the value of the ones digit of a minute (step 1310). The CPU 11 stores the value of the ones digit of a minute in the RAM 15. When it is judged to be No in step 1309, the process returns to step 1301.

According to this embodiment, the correlation values (the covariance values) are calculated for a a plurality of pieces of input waveform data, and the corresponding correlation values (the covariance values) of input waveform data are accumulated, thereby the values (the mean values to be specific) are compared. Accordingly, one can handle a large number of samples of the input waveform data, thus can obtain suitable covariance values without depending on the quality of the signals.

Next, the decoding processing of the tens digit of a minute is briefly explained. The tens digit of a minute takes the values from "0" to "5". In the time code, this is described by a BCD code of 3 bits. That is to say, minutes ranging from "0" to "59" are described by 3 bits of the tens digit and 4 bits of the ones digit.

The processing to detect the value of the tens digit of a minute is almost the same as that in FIG. 11. The parts different from those in FIG. 11 will be described hereinbelow.

In the processing corresponding to step 1101 in FIG. 11, the waveform cutout section 24 cuts out data of 3 units of time length (3 seconds) located at a position corresponding to the tens digit of a minute from the reception waveform data buffer 22, so as to generate input Waveform data Sn(j), according to the instruction of the CPU 11. Further, in step 1102 of FIG. 11, the estimated waveform data P(1,*j*)-P(10,*j*) each indicating "0"-"9" is generated. On the other hand, in the processing to detect the value of tens digit of a minute, the estimated waveform data generation section 23 may generate the estimated waveform data P(1,*j*)-P(6,*j*) each indicating "0"-"5". Further, the data length of the estimated waveform data is 3 units of time length (3 seconds).

Also in the detection processing of the tens digit of a minute, a plurality of pieces of input waveform data may be used to realize a further suitable matching by the accumulation effect. The tens digit of a minute is incremented every 10 minutes. Accordingly, by obtaining the input waveform data in a range where the tens digit of a minute does not change, the same estimated waveform data can be used during the detection processing of the tens digit of a minute.

Figure 15:
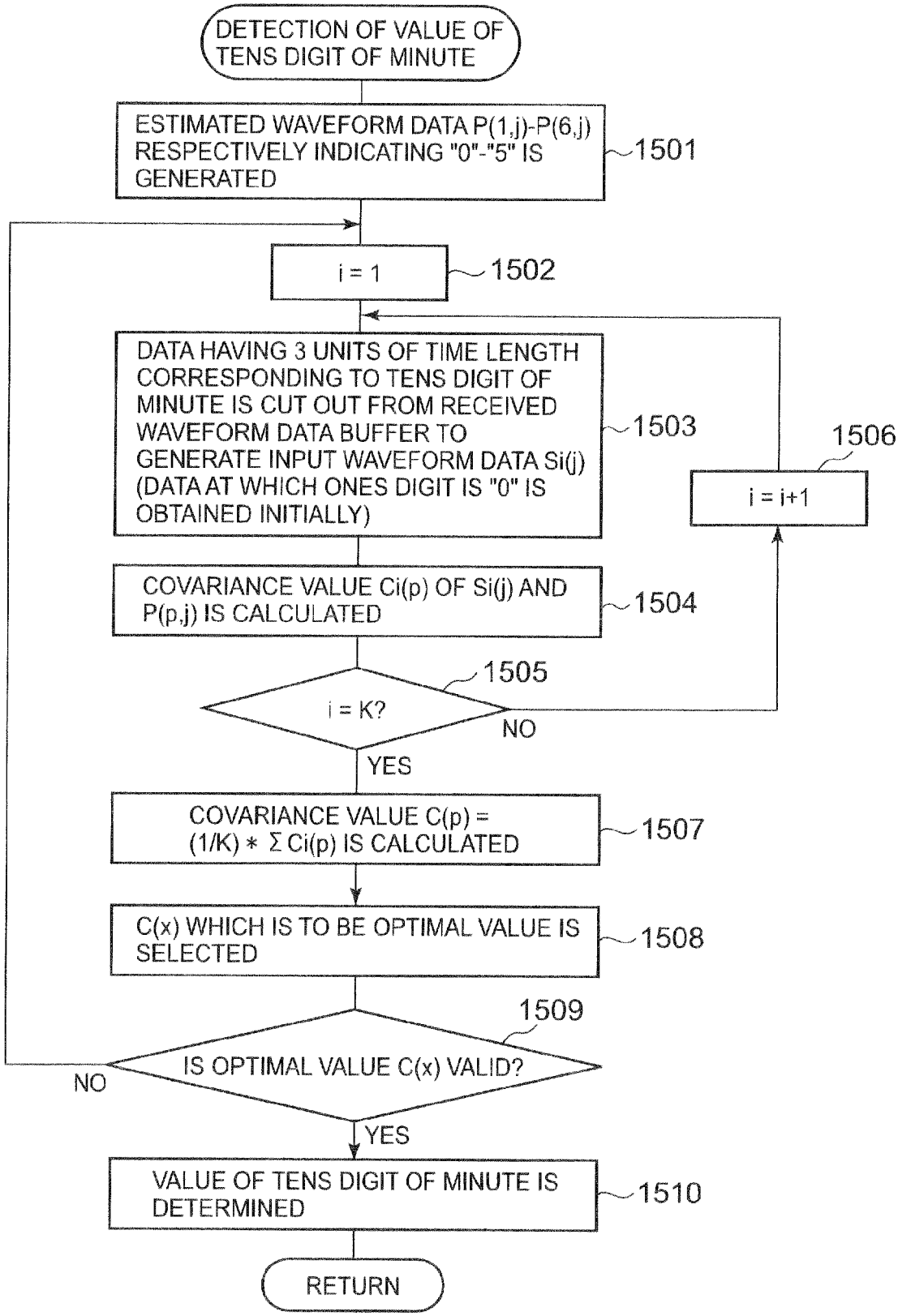
FIG. 15 is a flow chart showing the detection processing of a tens digit of a minute in detail according to another embodiment of the present invention.

FIG. 15 is a flow chart showing the detection processing of the tens digit of a minute in detail according to another embodiment of the present invention. As shown in FIG. 15, the estimated waveform data generation section 23 generates 6 pieces of estimated waveform data P(1,*j*)-P(6,*j*) having 3 units of time length (3 seconds), according to the instruction of the CPU 11 (step 1501).

The CPU 11 initializes the parameter "i" to specify the numbering of the input waveform data to "1" (step 1502). Subsequently, the waveform cutout section 24 cuts out data of 3 units of time length (3 seconds) located at a position corresponding to the tens digit of a minute, from the received waveform data buffer 22, to generate the input waveform data Si(j) according to the instruction of the CPU 11 (step 1503). In step 1503 which is to be executed for the first time, the data at which the value of the ones digit is "0" is obtained. Thereby, when K≦10 is satisfied, the same estimated waveform data P(1,*j*)-P(6,*j*) can be used while steps 1503-1506 are repeated.

The correlation value calculation section 25 calculates the correlation value (the covariance value) Ci(p)(p=1–6) between the input waveform data Si(j) and the estimated waveform data P(p,*j*), according to the instruction of the CPU 11 (step 1504). Subsequently, the CPU 11 judges whether the parameter is i=K, or not (step 1505). When it is judged to be No in step 1505, that is to say, when the number of the processing has not reached K times, the parameter "i" is incremented (step 1506), and the process returns to step 1503.

Steps 1507-1509 are performed in the same manner as steps 1307-1309 in FIG. 13. When it is judged to be No in step 1509, the process is returned to step 1502. Or the other hand, when it is judged to be Yes in step 1509, the CPU 11 determines the value of the estimated code data indicating the optimal value C(x), to be the value of the tens digit of a minute (step 1510). The CPU 11 stores the value of the tens digit of a minute in the RAM 15.

As described above, the values of the ones digit and the tens digit of a minute is obtained, thereby "a minute" among "an hour/a minute" can be determined.

The values of the ones digit and the tens digit of an hour can also be specified in almost the same manner as those of the tens digit of a minute. When the value of the ones digit of an hour is detected, the estimated waveform data generation section 23 generates the estimated waveform data P(1,*j*)-P(10,*j*) having 4 units of time length, and when the value of the tens digit of an hour is detected, the estimated waveform data generation section 23 generates the estimated waveform data P(1,*j*)-P(3,*j*) having 2 units of time length, each indicating "0"-"2". Further, when a plurality of pieces of input waveform data is used to obtain the accumulation effect, the value of "an hour" is changed only when a minute is change from "59" to "00". Accordingly, by executing the detection processing of the ones digit of an hour and the detection processing of the tens digit of an hour in a state of avoiding the timing where a minute changes from "59" to "00", a flow similar to FIG. 15 can be employed.

The values of other codes (the total number of days from January 1, the number of Christian year) can also be obtained by specifying the values for each digit. The value of the day of the week can also be obtained by specifying either one of the values ranging from "0" to "6".

When the decoding of a minute, an hour, a day (the total number of days from January 1), and a year (the number of Christian year) is completed, the CPU 41 can obtain the accurate present time. Incidentally, the normal present time is to be practically obtained at the timing when the decoding of a minute and an hour is completed. The CPU 11 corrects the present time internally timed by the internal timing circuit 17 based on the accurate present time obtained by the decoding. The corrected present time is displayed by the display section 13.

According to the present embodiment, when the second synchronization point is detected, the waveform cutout section 24 generates the input waveform data having 4 units of time length, based on data having a unit of time length, wherein the data is a value which is described by each sample point being described by a plurality of bits, and the unit of time length is a time corresponding to one code configuring the time code. Further, the estimated waveform data a generation section 23 generates a plurality of pieces of estimated waveform data having the same time length (4 units of time length) as the input waveform data, in which data corresponding to the code "0" configuring the time code is in sequence, and the waveform thereof is sequentially shifted by 1 sample, respectively. The correlation calculation section 25 calculates the correlation values (the covariance values) between the input waveform data and the plurality of pieces of estimated waveform data, respectively, and the correlation value comparison section 26 compares the calculated correlation values to calculate the optimal values thereof. The CPU 11 detects the second beginning position (the second synchronization point) based on the estimated waveform data indicating the optimal values By employing the above described configuration, the second synchronization point can suitably be detected even in a state where the electric intensity is weak or many noises are contained in the signal. Further, by performing the comparison with the estimated waveform data in which the second beginning position is shifted, the processing time can be reduced.

Further, in the present embodiment, in the estimated waveform data indicating the optimal values, the position where the value corresponding to a low-level is shifted to a value corresponding to a high-level is determined to be the beginning position of a second in the time code. Thereby, the beginning position of a second can suitably be determined without depending on the form of the input waveform data which is likely to be influenced by the noises and the like Further, in the present embodiment, when the beginning portion of a minute is detected, the waveform cutout section 24 generates 60 pieces of input waveform data having 2 units of time length, each starting from the beginning position of a second, respectively. The estimated waveform data generation section 23 generates the estimated waveform data having the 2 units of time length which is the same as that of the input waveform data, in which the waveform thereof contains a vicinity of the beginning position of a minute in the time code, that is to say, the continuous codes "P". Thus, the correlation values of each of the plurality of pieces of the input waveform data and the estimated waveform data are calculated. 60 pieces of input waveform data is generated from the beginning positions of each second among 60 seconds, and each thereof is compared with the estimated waveform data, thereby the beginning positions of a minute can be specified with significant accuracy.

Further, according to the present embodiment, when the codes which configure the time code is decoded, the waveform data cutout section 24 generates input waveform data having 1 or more units of time length, which includes 1 or more codes to indicate a value configuring any one of a year, a month, a day, an hour, and a minute in the time code. For example, when the ones digit of a minute is to be decoded, the input waveform data having 4 units of time length is generated, and when the tens digit of a minute is to be decoded, the input waveform data having 3 units of time length is generated. Further, the estimated waveform data generation section 23 generates a plurality of pieces of estimated waveform data each having the same time length as that of the input waveform data, and each of which indicates the possible value of the input waveform data. For example, when the ones digit of a minute is to be decoded, 10 pieces of estimated waveform data having 4 units of time length and which indicate either one value ranging from "0" to "9" are generated. Further, when the tens digit of a minute is to be decoded, 6 pieces of estimated waveform data having 3 units of time length and which indicate either one value ranging from "0" to "5" are generated.

in the present embodiment, the correlation values between the input waveform data and the plurality of pieces of estimated waveform data are compared, thus the value of the estimated waveform data indicating the optimal correlation value can be specified. That is to say, the value can be quickly specified by using a pattern matching even in the decoding of the codes configuring the time code.

In particular, by repeating the generations of the input waveform data and the calculations of the correlation values for a plurality of times, so as to accumulate the correlation values, the value which indicates the codes more accurately can he specified.

Further, in a case where the generations of the input waveform data is repeated, the values of ones digit of a minute in the time code are respectively increased, as the estimated waveform data at the occasion of the repetition. This is because the ones digit of a minute is increased by "1" when the processing is repeated. Accordingly, by also increasing the values of the estimated waveform data, the suitable matching can be realized.

The present invention is not limited to the above described embodiments, and there may be various modifications within the scope of the invention which is described in the claims, and the modifications of course are also incorporated within the range of the present invention.

For example, in the present embodiment, the waveform rises from a low-level to a high-level at a beginning position of a second of the standard time radio wave signal (a second synchronization point). Accordingly, the position having the form thereof is specified to be the second synchronization point. However, the present invention is of course also applicable in a case where the beginning position of a second falls from a high-level to a low-level.

Further, in the second synchronization, the input waveform data may he generated for a plurality of times, and the correlation values (the covariance values) may be calculated between the input waveform data and the plurality of pieces of estimated waveform data, respectively. Further, the correlation values of the relevant estimated waveform data (the same estimated waveform data) may be accumulated, so as to eventually refer to the accumulated correlation values, thereby the optimal values may he detected. Similarly, in the minute synchronization, the input waveform data may be generated for a plurality of times, and the correlation values (the covariance values) may be calculated between the input waveform data and the plurality of pieces of estimated waveform data, respectively. Further, the correlation values of the relevant estimated waveform data (the same estimated waveform data) may be accumulated, so as to eventually refer to the accumulated correlation values, thereby the optimal values may be detected.

Further, in the second synchronization in the above described embodiment, the estimated waveform data in which 4 pieces of data of the code "0" is in sequence is generated, among the codes which configure the standard time radio wave signal in Japan. This is because the (code "0" has the highest probability of being included in the time code. However, the estimated waveform data to be generated is not particularly limited to this, and estimated waveform data in which data of the code "1" is in sequence may be generated. Further, the data length of the time length of the estimated waveform data is not particularly limited to 4 units of time length, and it may be longer or shorter.

Further, in the standard time radio wave signal in Japan, the code "p" continuously appears before and after the beginning of a minute. Thus, in the present embodiment, the estimated waveform data in which 2 codes "p" are in sequence is generated. However, the estimated waveform data to be generated is not particularly limited to this. For example, in a case where a code having another form appears at the beginning of a minute, the estimated waveform data may include the code having another form.

Further, in the above described embodiment, the covariance value is used as the correlation value, however, the correlation value is not particularly limited to this. For example, a residual which is the summation of an absolute valve of a difference may be used as the correlation value. Alternatively, a mutual correlation coefficient may be used instead of the covariance value or the residual.

What is claimed is:

1. A time information obtaining device comprising:

a reception section to receive a standard time radio wave;

an input waveform data generation section to generate input waveform data having one or more unit of time length, based on data having the unit of time length, wherein the data comprises a value which is obtained by sampling a signal including a time code output from the reception section in a predetermined sampling period and by each sample point being described by a plurality of bits, and wherein the unit of time length is a time corresponding to one code which configures the time code;

an estimated waveform data generation section to generate a plurality of pieces of estimated waveform data, wherein the estimated waveform data comprises the value in which each sample point is described by the plurality of bits, the estimated waveform data has the same time length as the input waveform data, the estimated waveform data comprises at least one code which configures the time code, and a waveform of the estimated waveform data is sequentially shifted by a predetermined sample;

a correlation value calculation section to calculate a correlation value of the input waveform data and each of the plurality of pieces of estimated waveform data;

a correlation value comparison section to compare the correlation value calculated by the correlation value calculation section so as to calculate an optimal value; and a control section to specify a beginning position of a second in the time code based on the estimated waveform data indicating the optimal value.

2. The time information obtaining device according to claim 1, wherein the control section determines (i) a position where a value of the estimated waveform data indicating the optimal value changes from a value corresponding to a low-level to a value corresponding to a high-level, or (ii) a position where the value of the estimated waveform data indicating the optimal value changes from the value corresponding to the high-level to the value corresponding to the low-level, to be the beginning position of the second in the time code.

3. The time information obtaining device according to claim 1, wherein the input waveform data generation section generates a plurality of pieces of input waveform data, the input waveform data starting from the respective beginning position of the second, and the input waveform data having a plurality of units of time length, wherein the estimated waveform data generation section generates the estimated waveform data in which the waveform of the generated estimated waveform data includes a beginning position of a minute in the time code, the generated estimated waveform data having the same time length as the input waveform data, wherein the correlation value calculation section calculates the correlation value of each of the plurality of pieces of input waveform data and the estimated waveform data, and wherein the control section specifies the beginning position of the minute in the time code based on the input waveform data indicating the optimal value.

4. The time information obtaining device according to claim 1, wherein the input waveform data generation section generates the input waveform data which comprises at least one code indicating a value which configures any one of a year, a month, a day, a day of week, an hour, and a minute in the time code, the generated input waveform data having one or more unit of time length, wherein the estimated waveform data generation section generates the plurality of pieces of estimated waveform data which have the same time length as the input waveform data and which indicate a possible value of the input waveform data, and wherein the control section determines the value of the estimated waveform data indicating the optimal value to be the value indicating the at least one code.

5. A radio clock comprising:

the time information obtaining device according to claim 4;

a decoding section to obtain the value of the code including the day, the hour, the minute which configure the time code, according to the value indicated by the code, calculated by the time information obtaining device;

a present time calculation section to calculate a first present time based on the value of the code obtained by the decoding section;

an internal timing section to time a second present time by an internal clock;

a time correction section to correct the second present time timed by the internal timing section, based on the first present time obtained by the present time calculation section; and a time display section to display the second present time timed by the internal timing section or the second present time which has been corrected by the time correction section based on the first present time.

6. The time information obtaining device according to claim 4, wherein a generation of the input waveform data by the input waveform data generation section and a calculation of the correlation value by the correlation value calculation section are repeated for a plurality of times, and wherein the correlation value comparison section accumulates the correlation value calculated for relevant estimated waveform data to calculate the optimal value based on the accumulated correlation values.

7. The time information obtaining device according to claim 6, wherein the input waveform data generation section generates the input waveform data having a plurality of units of time length, the generated input waveform data comprising a plurality of codes indicating a ones digit of the minute in the time code, and wherein the estimated waveform data generation section generates the estimated waveform data as the relevant estimated waveform data in which the value of the estimated waveform data is increased, or the value is initialized when a digit increases, when repeating a generation of the estimated waveform data.

8. A time information obtaining device comprising:

a reception section to receive a standard time radio wave;

an input waveform data generation section to generate a plurality of pieces of input waveform data having one or more unit of time length, based on data having the unit of time length, wherein the data comprises a value which is obtained by sampling a signal including a time code output from the reception section, from a beginning position of a second in a predetermined sampling period and by each sample point being described by a plurality of bits, and wherein the unit of time length is a time corresponding to one code which configures the time code;

an estimated waveform data generation section to generate estimated waveform data having a plurality of units of time length, wherein the estimated waveform data comprises the value in which each sample point is described by the plurality of bits, the estimated waveform data has the same time length as the input waveform data, and a waveform of the estimated waveform data comprises a beginning position of a minute in the time code;

a correlation value calculation section to calculate a correlation value of each of the plurality of pieces of input waveform data and the estimated waveform data;

a correlation value comparison section to compare the correlation value calculated by the correlation value calculation section so as to calculate an optimal value; and a control section to specify the beginning position of the minute in the time code based on the input waveform data indicating the optimal value.

9. A time information obtaining device comprising:

a reception section to receive a standard time radio wave;

an input waveform data generation section to generate input waveform data having one or more unit of time length, the input waveform data comprising at least one code indicating a value which configures any one of a year, a month, a day, a day of week, an hour, and a minute, in a signal including a time code output from the reception section;

an estimated waveform data generation section to generate a plurality of pieces of estimated waveform data, wherein the estimated waveform data comprises a value in which each sample point is described by a plurality of bits, the estimated waveform data has the same time length as the input waveform data, and indicates a possible value of the input waveform data;

a correlation value calculation section to calculate a correlation value of the input waveform data and each of the plurality of pieces of estimated waveform data;

a correlation value comparison section to compare the correlation value calculated by the correlation value calculation section so as to calculate an optimal value; and a control section to determine the value of the estimated waveform data indicating the optimal value to be the value indicating the at least one code.

* * * * *